US008721013B2

(12) United States Patent
Gore et al.

(10) Patent No.: US 8,721,013 B2
(45) Date of Patent: May 13, 2014

(54) GRILLE COVER ASSEMBLY FOR DOMESTIC REFRIGERATOR

(75) Inventors: Rohan Gajananrao Gore, Evansville, IN (US); Donna J. Heacock, Evanville, IN (US); Alan S. Lucas, Louisville, KY (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/491,867

(22) Filed: Jun. 8, 2012

(65) Prior Publication Data

US 2013/0328471 A1 Dec. 12, 2013

(51) Int. Cl.
*F25D 17/06* (2006.01)

(52) U.S. Cl.
USPC ..... 312/405; 312/401

(58) Field of Classification Search
USPC ..... 312/223.6, 401, 405, 405.1, 406, 204, 312/265.5, 265.6, 278; 16/250, 251, 387
See application file for complete search history.

(56) References Cited

U.S. PATENT DOCUMENTS

| | | | | | |
|---|---|---|---|---|---|
| 3,531,824 | A | * | 10/1970 | Hagendoorn et al. | 16/222 |
| 3,779,624 | A | * | 12/1973 | Werderitsch | 312/278 |
| 4,094,561 | A | * | 6/1978 | Wolff et al. | 312/223.6 |
| 4,178,658 | A | | 12/1979 | Gergonne | |
| 4,543,800 | A | * | 10/1985 | Mawby et al. | 62/339 |
| 4,912,942 | A | * | 4/1990 | Katterhenry et al. | 62/338 |
| 4,932,224 | A | * | 6/1990 | Katterhenry et al. | 62/440 |
| 5,027,473 | A | | 7/1991 | Hottmann | |
| 5,144,896 | A | * | 9/1992 | Fortsch | 108/50.02 |
| 5,263,509 | A | * | 11/1993 | Cherry et al. | 137/343 |
| 5,362,131 | A | | 11/1994 | Susko et al. | |
| 5,369,842 | A | * | 12/1994 | Beatty | 16/317 |
| 5,522,656 | A | * | 6/1996 | Jenkins | 292/79 |
| 5,941,619 | A | * | 8/1999 | Stieben et al. | 312/223.6 |
| 6,036,292 | A | * | 3/2000 | Mandel et al. | 312/405 |
| 6,200,155 | B1 | * | 3/2001 | Chudkosky et al. | 439/371 |
| 6,349,655 | B1 | * | 2/2002 | Carr et al. | 108/50.02 |
| 6,883,205 | B2 | | 4/2005 | Martinez-Munoz | |
| 6,910,665 | B2 | * | 6/2005 | Avendano et al. | 248/188.2 |
| 7,137,677 | B2 | * | 11/2006 | Hong et al. | 312/401 |
| 7,276,559 | B2 | * | 10/2007 | Abraham et al. | 525/191 |
| 7,707,691 | B2 | | 5/2010 | Jeong | |
| 2008/0034551 | A1 | | 2/2008 | Jeong | |
| 2009/0179539 | A1 | | 7/2009 | Henriksson | |
| 2009/0188273 | A1 | | 7/2009 | Dirnberger | |
| 2009/0251036 | A1 | | 10/2009 | Laible | |
| 2009/0273264 | A1 | | 11/2009 | Butler | |
| 2010/0109497 | A1 | | 5/2010 | Biersch | |

* cited by examiner

*Primary Examiner* — Janet M Wilkens

(57) ABSTRACT

A domestic refrigerator includes a cabinet having a refrigerated compartment defined therein, and a base grille secured to a lower front of the cabinet. The base grille has an opening defined therein that is sized to receive a hinge bracket. A cover is positioned in front of the opening defined in the base grille. The cover is formed from a semi-flexible elastomeric material.

19 Claims, 6 Drawing Sheets

GRILLE COVER ASSEMBLY FOR DOMESTIC REFRIGERATOR

TECHNICAL FIELD

The present disclosure relates generally to a domestic refrigerator and more particularly to a grille cover assembly for a domestic refrigerator.

BACKGROUND

A domestic refrigerator is a device that is used to store food items in a home. Domestic refrigerators typically include a refrigerated compartment into which food items may be placed to preserve the food items for later consumption and a door that permits user access to the refrigerated compartment. Many domestic refrigerators also include a dispenser in the door that is operable to dispense water or ice.

SUMMARY

According to one aspect of the disclosure, a domestic refrigerator includes a cabinet that has a refrigerated compartment defined therein, a base grille secured to a lower front of the cabinet, and a hinge bracket having a first flange secured to the lower front of the cabinet and a second flange coupled to the first flange. The second flange extends outwardly through an opening defined in the base grille. The refrigerator also includes a door pivotally coupled to the second flange of the hinge bracket. The door is moveable between a closed position in which the door prevents user access to the refrigerated compartment, and an open position in which user access is permitted to the refrigerated compartment. The refrigerator includes a first cover extending upwardly from a front edge of the base grille, and the first cover is formed from a semi-flexible elastomeric material. A gap is defined between the second flange of the hinge bracket and the front edge of the base grille. The first cover is positioned in the gap and is sized to substantially fill the gap when the door is in the closed position.

In some embodiments, the domestic refrigerator may include a second cover secured to a lower surface of the door that is positioned in front of the first cover when the door is in the closed position and spaced apart from the first cover when the door is in the open position. A compartment may be defined in the base grille that is sized to receive a portion of an electrical wire harness of the domestic refrigerator therein. The first cover and the second cover may cooperate to substantially conceal the compartment from view when the door is in the closed position.

In some embodiments, the first cover may include a first side wall and a second side wall extending orthogonal to the first side wall, and the second cover may be placed in contact with the first side wall when the door is in the closed position. Additionally, in some embodiments, the second cover may include a flange extending downwardly from the lower surface of the door. In some embodiments, the flange may be formed from a substantially rigid material. In some embodiments, the substantially rigid material may be a plastic material. In some embodiments, the substantially rigid material may be a metallic material.

Additionally, in some embodiments, the domestic refrigerator may include the electrical wire harness, which is coupled to the cabinet and extends through the opening defined in the base grille. When the door is in the closed position, the first cover may have a first shape, and the first cover and the second cover may cooperate to substantially conceal the electrical wire harness. When the door is in the open position, a portion of the electrical wire harness may engage an upper surface of the first cover such that the first cover is deflected downward by the electrical wire harness to a second shape. The first cover may be capable of substantially returning to the first shape after being deformed to the second shape.

In some embodiments, the semi-flexible elastomeric material may be thermoplastic vulcanizate. In some embodiments, the semi-flexible elastomeric material may be rubber.

According to another aspect, a domestic refrigerator includes a cabinet having a refrigerated compartment defined therein, a base grille secured to a lower front of the cabinet that has an opening defined therein sized to receive a flange of a hinge bracket, and a first cover positioned in front of the opening. The first cover is formed from a semi-flexible elastomeric material. In some embodiments, the domestic refrigerator may include a door pivotally coupled to the cabinet, and the door may be moveable between a closed position in which the door prevents user access to the refrigerated compartment, and an open position in which user access is permitted to the refrigerated compartment.

In some embodiments, the domestic refrigerator may also include a second cover secured to the door. The second cover may be positioned in front of the first cover when the door is in the closed position and spaced apart from the first cover when the door is in the open position.

In some embodiments, a compartment may be defined in the base grille, and the first cover and the second cover may cooperate to substantially conceal the compartment from view when the door is in the closed position. In some embodiments, the first cover may include a first side wall positioned in front of the opening defined in the base grille and a second side wall extending orthogonal to the first side wall.

According to another aspect, a domestic refrigerator includes a cabinet having a refrigerated compartment defined therein, a base grille secured to a lower front of the cabinet, and a door pivotally coupled to the cabinet that is moveable between a closed position in which the door prevents user access to the refrigerated compartment and an open position in which user access is permitted to the refrigerated compartment. The domestic refrigerator also has a grille cover including a plate secured to a lower surface of the door, and a tail piece secured to the body that is formed from a semi-flexible elastomeric material.

In some embodiments, a compartment may be defined in the base grille, and the plate and the tail piece of the grille cover may cooperate to substantially conceal the compartment from view when the door is in the closed position.

In some embodiments, the plate may be formed from a substantially rigid material. In some embodiments, the substantially rigid material may be a metallic material. Additionally, in some embodiments, the semi-flexible elastomeric material may be thermoplastic vulcanizate.

In some embodiments, the domestic refrigerator may further include an electrical wire harness coupled to the cabinet, and the electrical wire harness may extend through an opening defined in the base grille. When the door is in the closed position, the tail piece may have an arced first shape. When the door is in the open position, the tail piece may engage a portion of the electrical wire harness such that the tail piece is deformed by the electrical wire harness to a second shape. The tail piece may be capable of substantially returning to the first shape after being deformed into the second shape.

BRIEF DESCRIPTION OF THE DRAWINGS

The detailed description particularly refers to the following figures, in which.

DETAILED DESCRIPTION OF THE DRAWINGS

Figure 1:
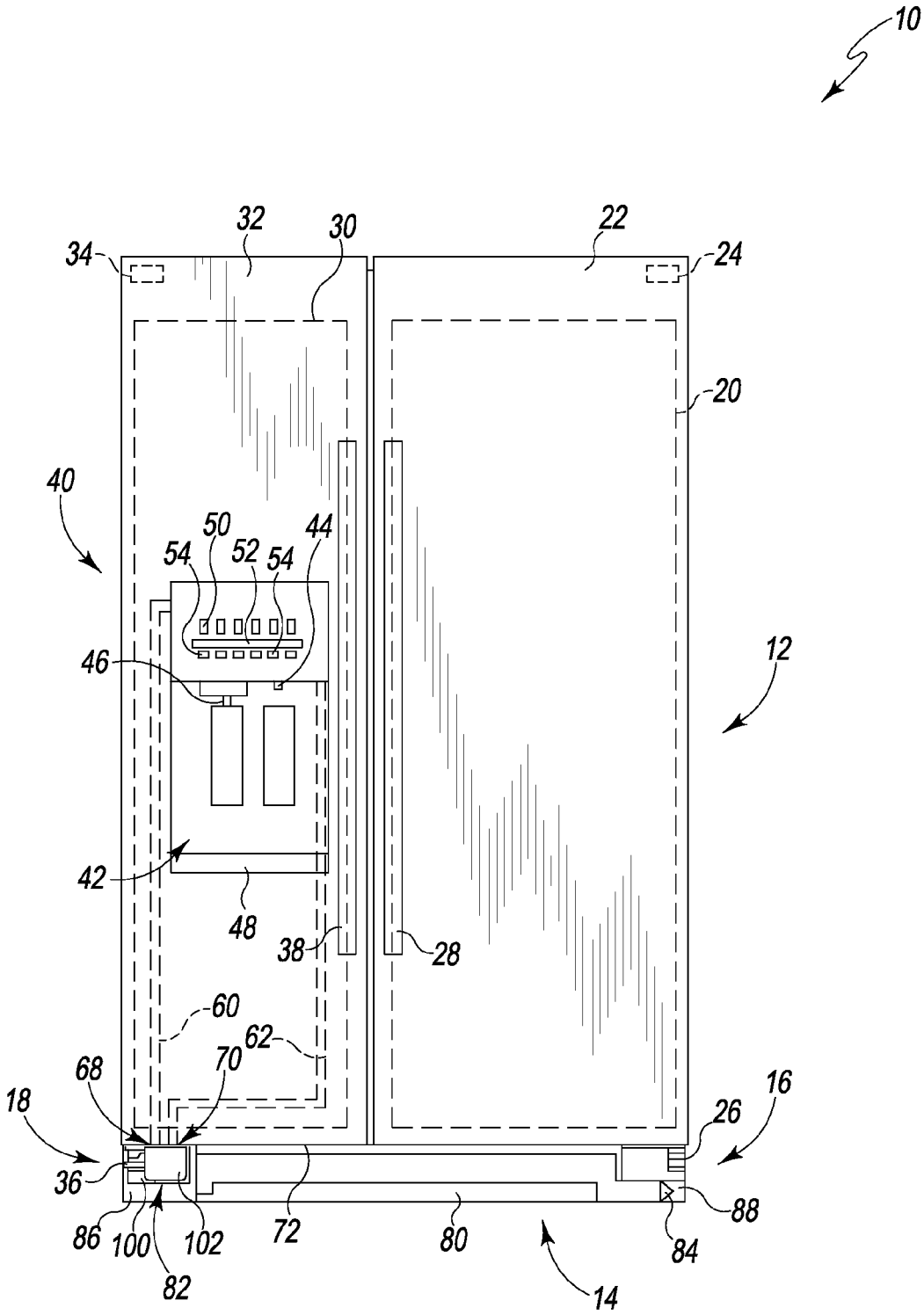
FIG. 1 is a front elevation view of a domestic refrigerator including one embodiment of a grille cover assembly.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, a home appliance is shown as a domestic refrigerator appliance 10 (hereinafter refrigerator 10). One example of a domestic refrigerator is the Whirlpool 26.4 cubic feet Side-by-Side Refrigerator Model No. GSF26C5EXY, which is commercially available from Whirlpool Corporation of Benton Harbor, Mich., U.S.A. The refrigerator 10 includes a cabinet 12, a base grille 14 secured to the lower front 16 of the cabinet 12, and a grille cover assembly 18. The refrigerator cabinet 12 defines a refrigerated compartment 20 into which a user may place and store food items such as milk, cheese, produce, etcetera. The refrigerated compartment 20 is operable to maintain stored food items at a predefined temperature. The refrigerator 10 may include one or more shelves positioned within the refrigerated compartment 20 that provide storage locations for the food items.

A door 22 is hinged to the front of the refrigerator cabinet 12 via a pair of hinge assemblies 24, 26. The door 22 permits user access to the refrigerated compartment 20 such that food items may be placed in and retrieved from the refrigerator 10. When the door 22 is closed as shown in FIG. 1, user access to the refrigerated compartment 20 is prevented. A handle 28 is located on a front panel of the door 22, and the user may use the handle to pull the door 22 open. When the door 22 is open, user access to the refrigerated compartment 20 is permitted.

As shown in FIG. 1, the refrigerator cabinet 12 also defines a freezer compartment 30, which is independently operable to maintain food items stored therein at a certain temperature. A door 32 is hinged to the front of the refrigerator cabinet 12 via a pair of hinge assemblies 34, 36. The door 32 permits user access to the freezer compartment 30 such that food items may be placed in and retrieved from the refrigerator 10. When the door 22 is closed as shown in FIG. 1, user access to the freezer compartment 30 is prevented. A handle 38 is located on the door 32, and the user may use the handle 38 to pull the door 32 open. When the door 32 is open (see FIG. 8), user access to the freezer compartment 30 is permitted. The freezer compartment 30 and the refrigerated compartment 20 are shown side-by-side. It should be appreciated that in other embodiments the freezer compartment may be positioned below or above with the refrigerated compartment 12. It will be further appreciated that in other embodiments the refrigerator 10 may not have a freezer compartment.

The refrigerator 10 also includes a dispenser 40 mounted to the door 32. The dispenser 40 is positioned in an aperture 42 defined in the door 32 adjacent to the handle 38. The dispenser 40 includes a fluid dispenser port 44 that is operable to dispense cold water or other fluids and an ice dispenser port 46 that is operable to dispense crushed ice or ice cubes. A platform 48 is positioned below the ports 44, 46, and the platform 48 is sized such that a cup, mug, or other container may be positioned thereon to receive fluid or ice dispensed through the ports 44, 46. The dispenser 40 also includes a user interface 50 that is formed on a panel 52 positioned above the ports 44, 46. The user interface 50 includes a number of controls 54, such as buttons and switches, that are used to control the operation of the dispenser 40.

A number of fluid tubes 60 fluidly connect the fluid dispenser port 44 positioned in the door 32 with a fluid inlet valve (not shown) secured to the cabinet 12. An electrical wire harness 62 electrically connects the user interface 50 of the dispenser 40 with a main wire harness (not shown) secured to the cabinet 12 such that power may be supplied to the user interface 50 and other electrical elements of the dispenser 40. As shown in FIG. 1, the fluid tubes 60 and the wire harness 62 are partially positioned in the door 32. The tubes 60 and the harness 62 extend downwardly from ends coupled to the dispenser 40. A bottom surface 72 of the door 32 has a pair of openings 68, 70 defined therein that are sized to permit the passage of the fluid tubes 60 and the wire harness 62.

Figure 2:
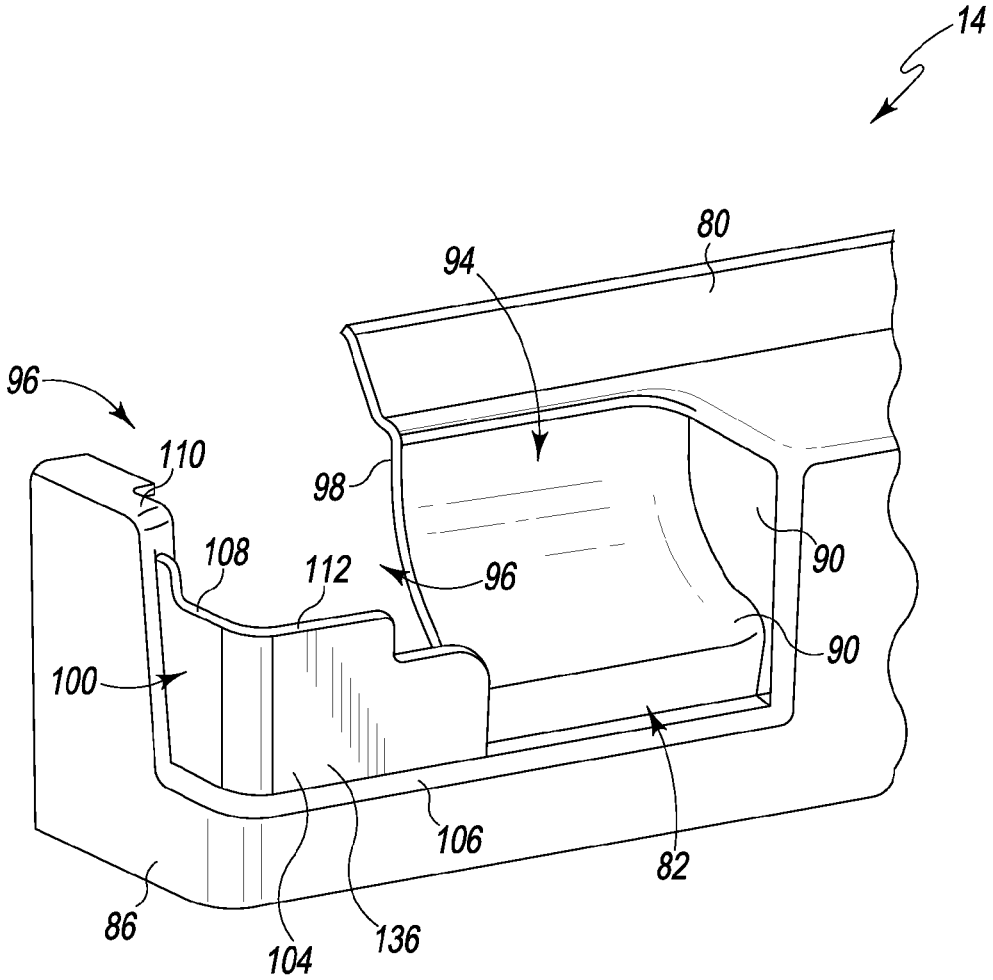
FIG. 2 is a front perspective view of a lower cover plate of the grille cover assembly of FIG. 1.

As described above, the refrigerator 10 also includes a base grille 14, which is positioned below the doors 22, 32. The base grille 14 has a body 80 that is secured to the lower front 16 of the cabinet 12. The body 80 has a pair of openings 82, 84 defined in the front corners 86, 88, respectively, of the base grille 14. As shown in FIG. 2, a number of inner walls 90 extending from the opening 82 in the corner 86 to define a compartment 94 in the body 80. Another opening 96 is defined through a rear surface 98 of the body 80. The fluid tubes 60 and the wire harness 62 extend through the openings 68, 70 defined in the bottom surface 72 of the door 32, pass into the compartment 94, and extend back through the opening 96 of the base grille 14 to their respective connections with the cabinet 12, as described in greater detail below.

Returning to FIG. 1, the refrigerator 10 also includes a grille cover assembly 18 that is configured to substantially conceal the compartment 94 and the opening 96 (and therefore tubes 60 and harness 62) from view when the door 32 is closed. The grille cover assembly 18 includes a first cover, such as lower cover plate 100 secured to the base grille 14 and a second cover, such as upper cover plate 102 secured to the door 32. As shown in FIG. 2, the lower cover plate 100 has a body 104 that is secured to a front edge 106 of the body 80 of the base grille 14. The body 104 includes a side wall 108 that is connected to an outer wall 110 of the body 80 and a side wall 112 that is positioned in front of the opening 96 of the base grille 14. As shown in FIG. 2, the side walls 108, 112 cooperate to define an "L-shape" for the body 104 of the lower cover plate 100. It should be appreciated that in other embodiments the body 104 may be formed in other geometric shapes.

The body 104 of the lower cover plate 100 is formed from a semi-flexible elastomeric material that is capable of being deformed from its original shape (e.g., the "L-shape" defined by side walls 108, 112) when an external load is applied and is capable of substantially returning to the original shape when the external load is removed. In the illustrative embodiment, the body 104 is formed a thermoplastic vulcanizate, such as, for example, Santoprene™, which is commercially available from ExxonMobil Chemical Company of Houston, Tex., U.S.A. It should be appreciated that in other embodiments the body 104 may be formed from rubber or other elastomeric material. The lower cover plate 100 is attached to the front edge 106 of the body 80 of the base grille 14 via an adhesive, but it should be appreciated that in other embodiments the cover plate 100 may be attached to the base grille 14 by any known method, including, for example, ultrasonic welding, mechanical engagement, and etcetera.

Figure 3:
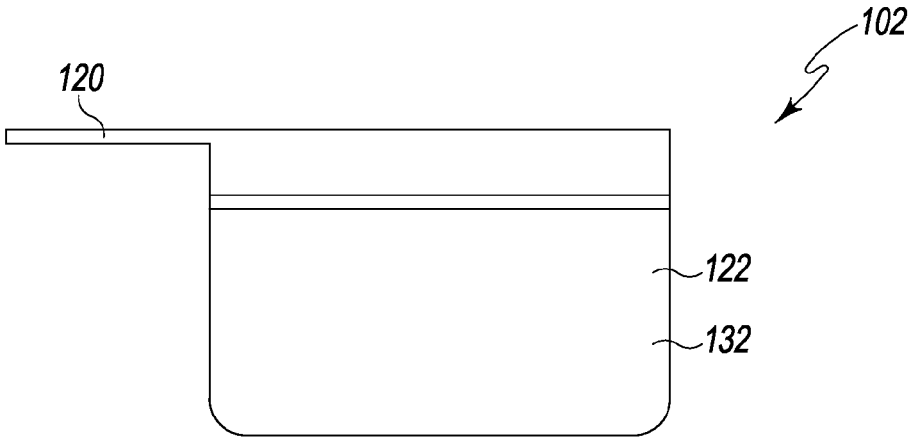
FIG. 3 is a front elevation view of an upper cover plate of the grille cover assembly of FIG. 1.
Figure 4:
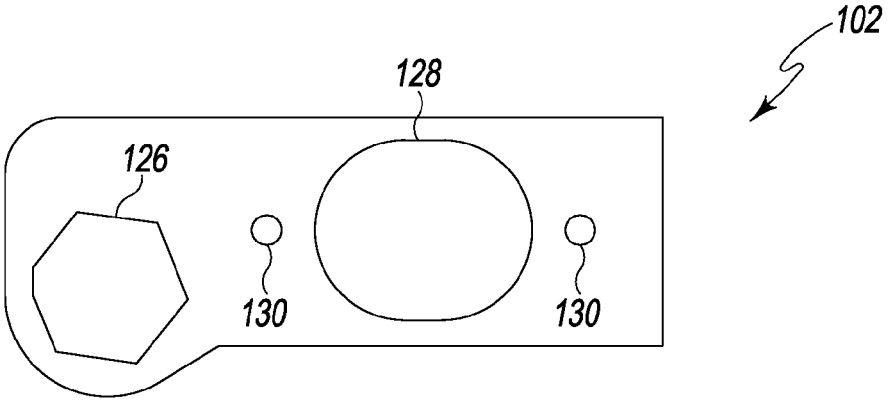
FIG. 4 is a top plan view of the upper cover plate of FIG. 3.
Figure 5:
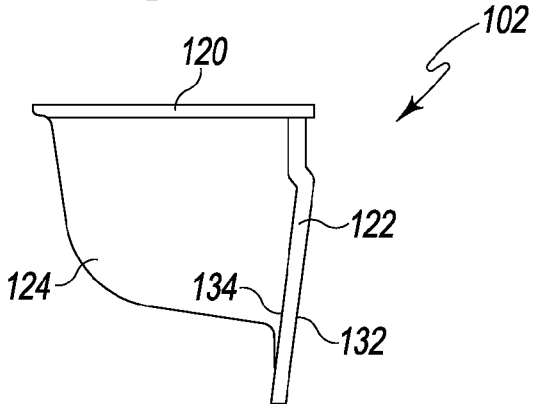
FIG. 5 is a side elevation view of the upper cover plate of FIGS. 3 and 4.

Referring now to FIGS. 3-5, the upper cover plate 102 of the cover assembly 18 includes a main body 120, a flange 122 extending downwardly from the main body 120, and a web 124 extending therebetween. The main body 120 and the flange 122 are formed from a substantially rigid material. In the illustrative embodiment, the main body 120 and the flange 122 are formed from a metallic material, such as, for example, aluminum or stainless steel. It should be appreciated that in other embodiments the substantially rigid material may be a hard plastic material.

The main body 120 of the upper cover plate 102 has a pair of openings 126, 128 that are substantially aligned with the openings 68, 70 defined in the bottom surface 72 of the door 32 when the upper cover plate 102 is secured to the door 32. The openings 126, 128, like the openings 68, 70, are sized to permit the passage of the fluid tubes 60 and the wire harness 62 therethrough. The main body 120 also includes another pair of openings 130 that are sized to receive a corresponding pair of fasteners (not shown), such as, for example, screws, that secure the main body 120 of the cover plate 102 to the bottom surface 72 of the door 32.

The flange 122 of the upper cover plate 102 has a planar front surface 132 and a planar rear surface 134 positioned opposite the front surface 132. The planar rear surface 134 of the flange 122 is placed in contact with a front surface 136 of the lower cover plate 100 when the door is closed (see FIG. 6) and is spaced apart from the lower cover plate 100 when the door is open (see FIG. 8).

Figure 6:
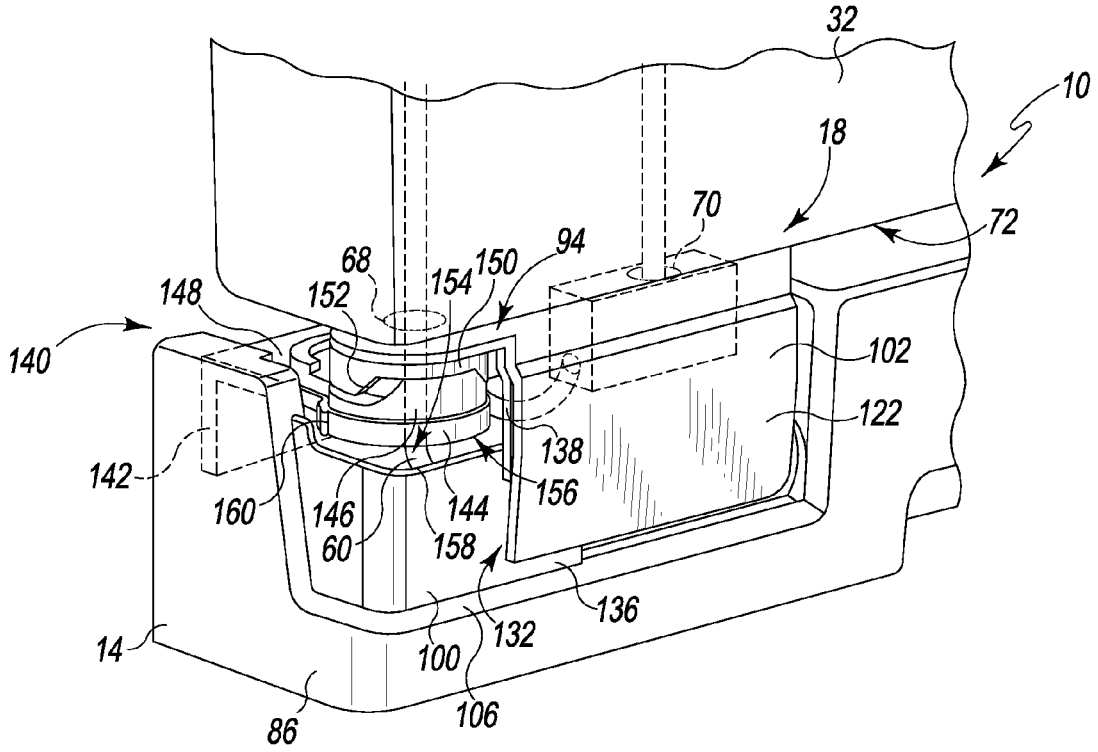
FIG. 6 is a front perspective view of the lower front corner of the domestic refrigerator of FIG. 1 showing the door in a closed position.

Referring now to FIG. 6, the lower hinge assembly 36 of the refrigerator 10 includes a door stop bracket 138 secured to the main body 120 of the upper cover plate 102 and a mounting bracket 140 that is positioned in the opening 96 defined in the base grille 14. The bracket 140 has a vertical flange 142 secured to the lower front 16 of the cabinet 12 and a horizontal flange 144 extending outwardly therefrom. The hinge assembly 36 also a lower cam 146 secured to an upper surface 148 of the flange 144 and a cam support 150 secured to the door 32. The cam support 150 includes an upper cam 152 that engages the lower cam 146. The fluid tubes 60 that extend outwardly through the opening 68 defined in the bottom surface 72 of the door 32 pass through openings (not shown) defined in each of the cams 146, 150 and the flange 144 before entering the compartment 94 of the base grille 14.

A gap 154 is defined between a lower surface 156 of the horizontal flange 144 and the front edge 106 of the base grille 14. As shown in FIG. 6, the lower cover plate 100 is positioned in the gap 154 such that an upper surface 158 of the lower cover plate 100 is positioned adjacent to the lower surface 156 of the flange 144. In that way, the lower cover plate 100 substantially fills the gap 154 to partially conceal the wire harness 62 and the fluid tubes 60 from view.

Figure 7:
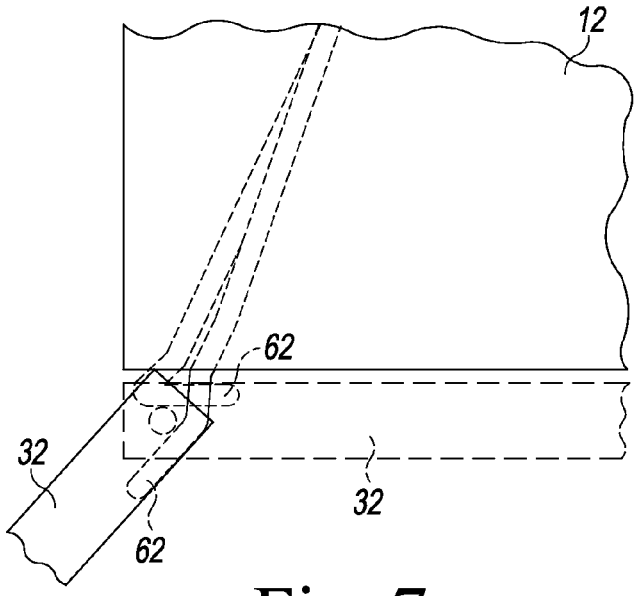
FIG. 7 is a top plan view of the domestic refrigerator of FIG. 1 showing the door in the closed and open positions.
Figure 8:
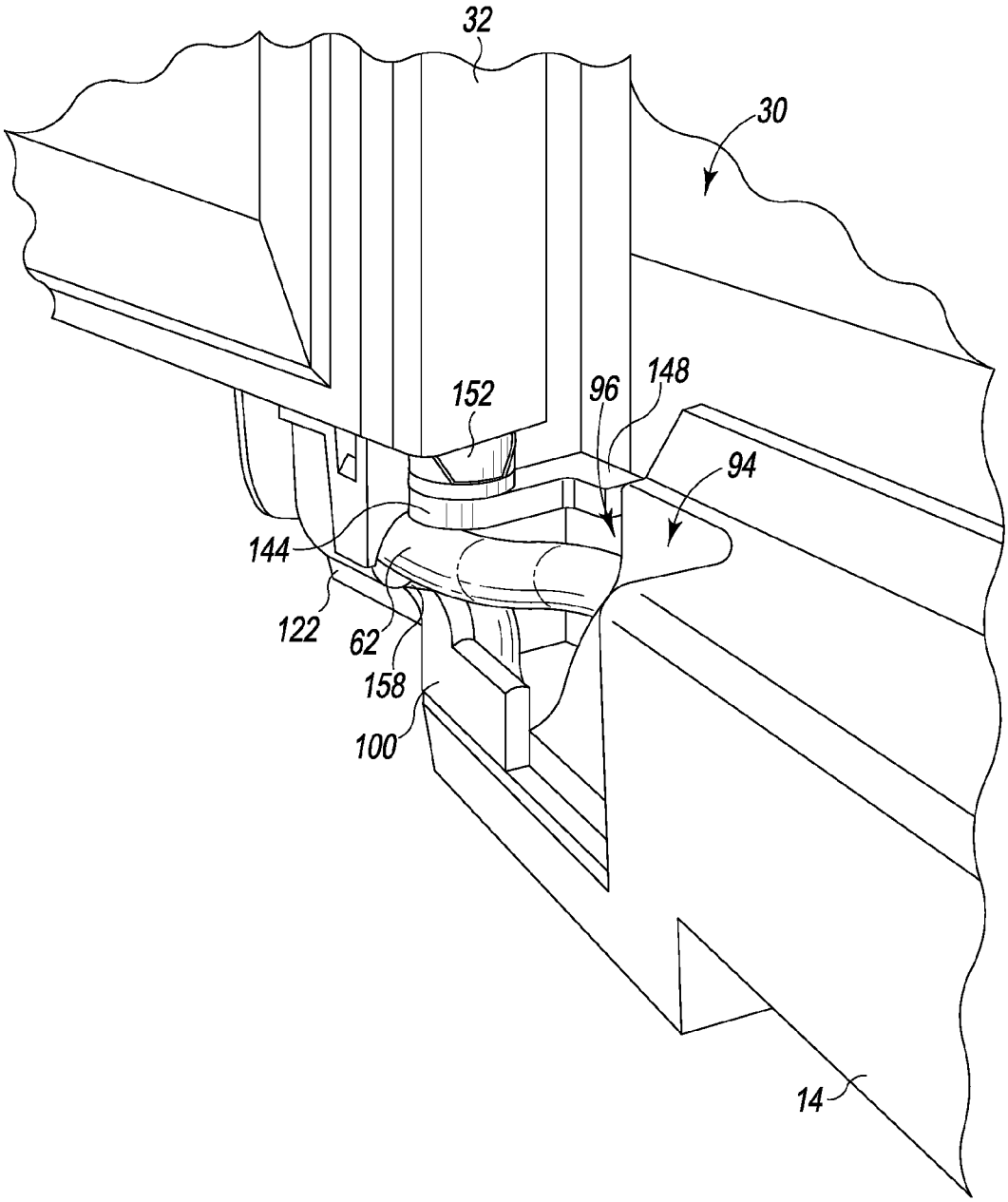
FIG. 8 is a front perspective view of the lower front corner of the domestic refrigerator of FIG. 1 showing the door in an open position.

As shown in FIGS. 6 and 7, when the door 32 is fully closed, the wire harness 62 is partially coiled within the compartment 94 of the base grille 14 between the cover assembly 18 and the inner walls 90 of the base grille 14. When the door 32 is opened, the wire harness 62 extends outwardly from the compartment 94. As shown in FIG. 8, the wire harness 62 is pulled outward along with the door 32 into engagement with the lower cover plate 100. As the harness 62 presses down on the upper surface 158 of the lower cover plate 100, the lower cover plate 100 is deformed from its original "L-shape" and bent outward, thereby permitting the wire harness 62 to continue advancing outward along with the door 32.

The horizontal flange 144 of the bracket 140 includes a raised edge 160 that is configured to engage the door stop bracket 138 when the door 32 is opened to a predetermined position. The interaction between the edge 160 and the door stop bracket 138 prevents further movement of the door 32.

When the door 32 is returned to the closed position, the wire harness 62 is moved out of engagement with the lower cover plate 100. As described above, when the load of the wire harness 62 is removed, the lower cover plate 100 substantially reforms to the original "L-shape" defined by the side walls 108, 112.

Figure 9:
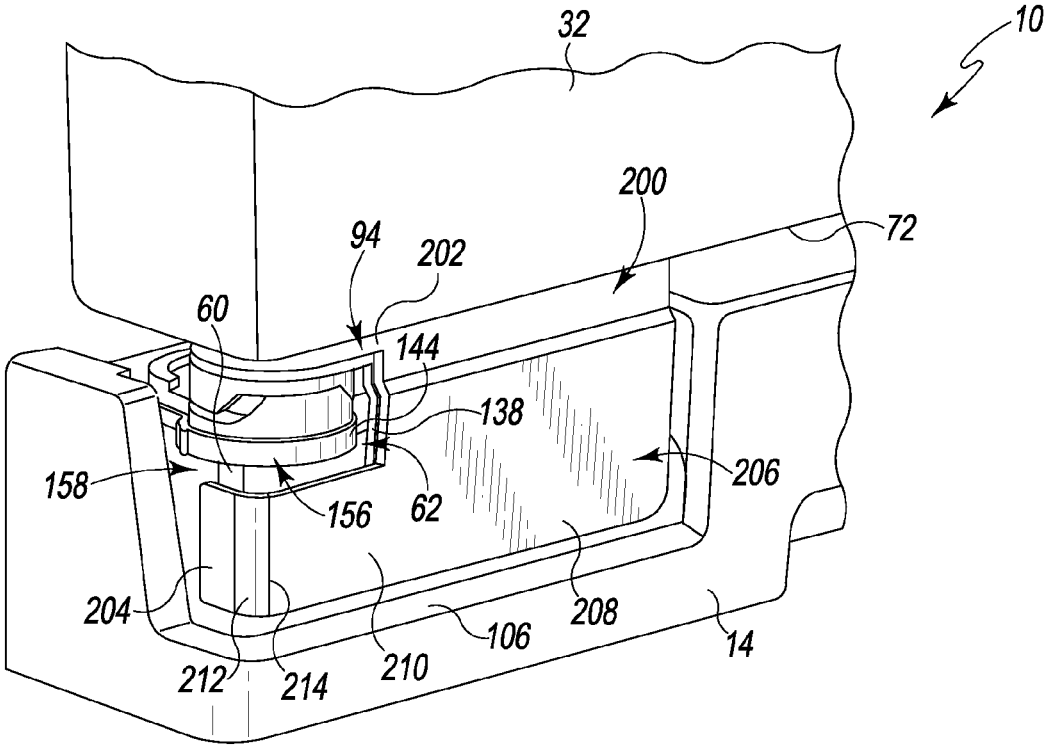
FIG. 9 is a front perspective view of the lower front corner of the domestic refrigerator of FIG. 1 with another embodiment of a grille cover assembly.
Figure 10:
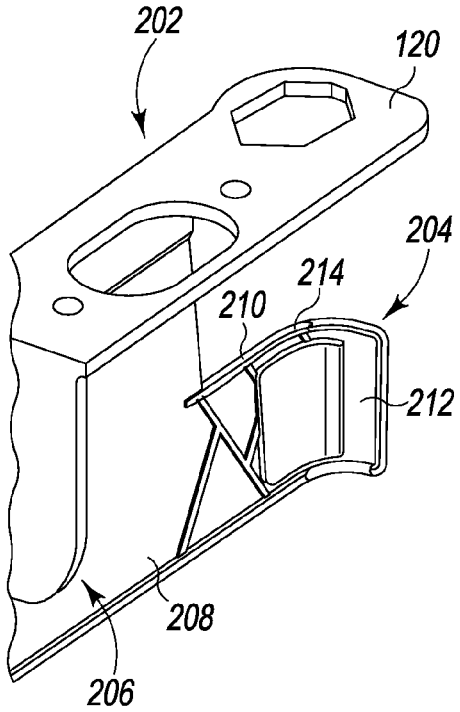
FIG. 10 is a rear perspective view of the grille cover assembly of FIG. 9.

Referring now to FIGS. 9 and 10, the refrigerator 10 is shown with another embodiment of a grille cover assembly (hereinafter cover assembly 200) secured thereto. The cover assembly 200 includes a plate 202 that is secured to the door 32 and a tail piece 204 that is secured to the plate 202. The plate 202, like the upper cover plate 102 of FIGS. 1-8, includes a main body 120 that is configured to be secured to the bottom surface 72 of the door 32 and a flange 206 that extends downwardly from the main body 120. The main body 120 and the flange 206 are formed from a substantially rigid material. In the illustrative embodiment, the main body 120 and the flange 206 are formed from a metallic material, such as, for example, aluminum or stainless steel. It should be appreciated that in other embodiments the substantially rigid material may be a hard plastic material.

The flange 206 of the plate 202 has a main arm 208 that is connected to the main body 120 and a side arm 210 that extends outwardly from the main arm 208. The tail piece 204 has a body 212 that is secured at one end 214 to the side arm 210. As shown in FIGS. 9 and 10, the body 212 defines an arced shape. The body 212 of the tail piece 204, like the lower cover plate 100 of FIGS. 1-8, is formed from a semi-flexible elastomeric material that is capable of being deformed from its original shape (e.g., the arced shape shown in FIGS. 9 and 10) when an external load is applied and is capable of substantially returning to the original shape when the external load is removed. In the illustrative embodiment, the body 212 is formed a thermoplastic vulcanizate, such as, for example, Santoprene™. It should be appreciated that in other embodiments the body 212 may be formed from rubber or other elastomeric material. The tail piece 204 is attached to side arm 210 of the plate 202 via an adhesive, but it should be appreciated that in other embodiments the tail piece 204 may be attached to the plate 202 by any known method, including, for example, ultrasonic welding, mechanical engagement, and etcetera.

As shown in FIG. 9, the side arm 210 and the tail piece 204 are positioned in the gap 154 defined between the lower surface 156 of the horizontal flange 144 and the front edge 106 of the base grille 14. In that way, the side arm 210 and the tail piece 204 cooperate to substantially fill the gap 154 such that the wire harness 62 and the fluid tubes 60 of the refrigerator 10 are partially concealed from view when the door 32 is in the closed position. Additionally, the plate 202 and the tail piece 204 cooperate to substantially conceal the compartment 94 of the base grille 14 and the opening 96 defined therein from view when the door 32 is closed.

When the door 32 is opened, the wire harness 62 extends outwardly from the compartment 94. As the door 32 is opened, the tail piece 204 is brought into contact with the wire harness 62. When the door 32 is fully open, the tail piece 204 is pressed into the wire harness 62 such that the tail piece 204 is deformed from the arced shape. When the door 32 is closed, the tail piece 204 disengages from the wire harness 62 and reforms to the original arced shape.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A domestic refrigerator comprising:

a cabinet having a refrigerated compartment defined therein, a base grille secured to a lower front of the cabinet, a hinge bracket having a first flange secured to the lower front of the cabinet and a second flange coupled to the first flange, the second flange extending outwardly through an opening defined in the base grille, a door pivotally coupled to the second flange of the hinge bracket, the door being moveable between (i) a closed position in which the door prevents user access to the refrigerated compartment and (ii) an open position in which user access is permitted to the refrigerated compartment, a first cover extending upwardly from a front edge of the base grille, the first cover being formed from a semi-flexible elastomeric material, and wherein a gap is defined between the second flange of the hinge bracket and the front edge of the base grille, and the first cover is positioned in the gap and is sized to substantially fill the gap when the door is in the closed position.

2. The domestic refrigerator of claim 1, further comprising:

a second cover secured to a lower surface of the door, the second cover being (i) placed in contact with the first cover when the door is in the closed position and (ii) spaced apart from the first cover when the door is in the open position, wherein (i) a compartment is defined in the base grille, the compartment being sized to receive a portion of an electrical wire harness of the domestic refrigerator therein, and (ii) the first cover and the second cover cooperate to substantially conceal the compartment from view when the door is in the closed position.

3. The domestic refrigerator of claim 2, wherein:

the first cover includes a first side wall and a second side wall extending orthogonal to the first side wall, and the second cover is positioned in front of the first side wall when the door is in the closed position.

4. The domestic refrigerator of claim 2, wherein the second cover includes a flange extending downwardly from the lower surface of the door.

5. The domestic refrigerator of claim 4, wherein the flange is formed from a substantially rigid material.

6. The domestic refrigerator of claim 5, wherein the substantially rigid material is a plastic material.

7. The domestic refrigerator of claim 5, wherein the substantially rigid material is a metallic material.

8. The domestic refrigerator of claim 1, further comprising:

an electrical wire harness coupled to the cabinet, the electrical wire harness extending through the opening defined in the base grille, wherein (i) when the door is in the closed position, the first cover has a first shape and the first cover and a second cover cooperate to substantially conceal the electrical wire harness, and (ii) when the door is in the open position, a portion of the electrical wire harness engages an upper surface of the first cover such that the first cover is deflected downward by the electrical wire harness to a second shape, the first cover being capable of substantially returning to the first shape after being deformed to the second shape.

9. The domestic refrigerator of claim 8, wherein the semi-flexible elastomeric material is thermoplastic vulcanizate.

10. The domestic refrigerator of claim 8, wherein the semi-flexible elastomeric material is rubber.

11. The domestic refrigerator of claim 1, wherein the opening extends along a front edge of the base grille and around a front corner of the base grille.

12. The domestic refrigerator of claim 1, wherein the base grille includes a body with a front edge, an outer wall, an inner wall and a rear surface, a front corner that connects the front edge and the outer wall of the body, an opening defined along the front edge of the body and an opening defined through the rear surface of the body and wherein the first cover is attached to the base grille and extends across a portion of the opening defined along the front edge of the body.

13. The domestic refrigerator of claim 12, wherein the first cover extends around the front corner.

14. A domestic refrigerator comprising:

a cabinet having a refrigerated compartment defined therein, a base grille secured to a lower front of the cabinet, the base grille having a body with a front edge, an outer wall, an inner wall and a rear surface, a front corner that connects the front edge and the outer wall of the body, an opening defined along the front edge of the body and an opening defined through the rear surface of the body that is sized to receive a flange of a hinge bracket, and a first cover attached to the base grille and extending across a portion of the opening defined along the front edge of the body, the first cover being formed from a semi-flexible elastomeric material.

15. The domestic refrigerator of claim 14, further comprising:

a door pivotally coupled to the cabinet, the door being moveable between (i) a closed position in which the door prevents user access to the refrigerated compartment, and (ii) an open position in which user access is permitted to the refrigerated compartment, and a second cover secured to the door, the second cover being (i) positioned in front of the first cover when the door is in the closed position and (ii) spaced apart from the first cover when the door is in the open position.

16. The domestic refrigerator of claim 15, wherein:

a compartment is defined in the base grille, and the first cover and the second cover cooperate to substantially conceal the compartment from view when the door is in the closed position.

17. The domestic refrigerator of claim 14, wherein the first cover includes a first side wall positioned in the opening defined along the front edge of the body in the base grille and a second side wall extending orthogonal to the first side wall.

18. The domestic refrigerator of claim 14, wherein the opening defined along the front edge of the body extends about the front corner of the body.

19. The domestic refrigerator of claim 15, further comprising:

a second cover secured to a lower surface of the door, the second cover being (i) placed in contact with the first cover when the door is in the closed position and (ii) spaced apart from the first cover when the door is in the open position, wherein (i) a compartment is defined in the base grille, the compartment being sized to receive a portion of an electrical wire harness of the domestic refrigerator therein, and (ii) the first cover and the second cover cooperate to substantially conceal the compartment from view when the door is in the closed position.

* * * * *